United States Patent [19]

Karterman

[11] 4,252,273

[45] Feb. 24, 1981

[54] AMUSEMENT DRINKING DEVICE

[76] Inventor: Don S. Karterman, 675 Birch St., Anchorage, Ak. 99501

[21] Appl. No.: 61,830

[22] Filed: Jul. 30, 1979

Related U.S. Application Data

[63] Continuation-in-part of Ser. No. 901,342, May 1, 1978, abandoned.

[51] Int. Cl.[3] ..... A47G 21/18

[52] U.S. Cl. ..... 239/33; 46/41

[58] Field of Search ..... 239/33; 46/44, 41, 53, 46/56, 55

[56] References Cited

U.S. PATENT DOCUMENTS

| | | | |
|---|---|---|---|
| 1,647,902 | 11/1927 | Cohn | 46/56 |
| 2,570,366 | 10/1951 | Mitchell | 239/33 |
| 3,315,405 | 4/1967 | Hoffer | 239/33 X |
| 3,332,622 | 7/1967 | Lombard | 239/33 |
| 3,782,028 | 1/1974 | Kelly | 46/41 |

*Primary Examiner*—Bruce H. Stoner, Jr.
*Assistant Examiner*—Gene A. Church
*Attorney, Agent, or Firm*—Christopher Duffy

[57] ABSTRACT

The device comprises an elongated hand supportable siphoning element which is adapted to be employed like a straw. The element has a rotor rotatably mounted thereon for the amusement of the user. It also defines a passage for the flow of the liquid, and there are drive means disposed in the passage in connection with the rotor whereby the rotor is caused to undergo rotation in response to flow of the liquid through the passage.

9 Claims, 14 Drawing Figures

Fig. 1.
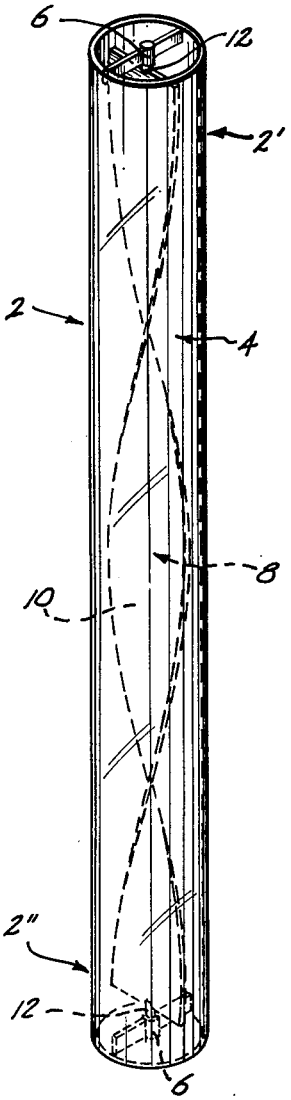
Fig. 2.
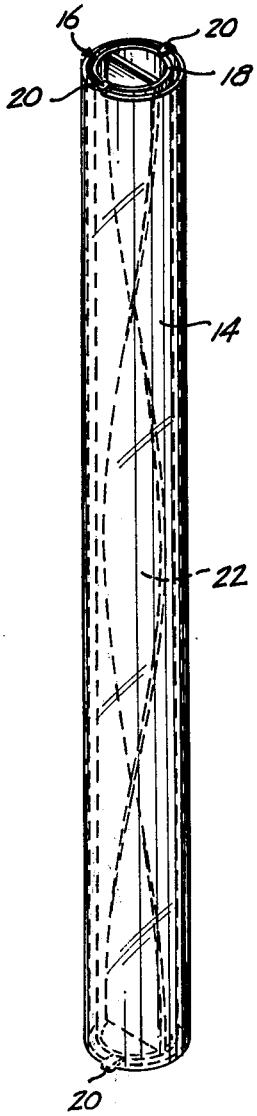
Fig. 3.
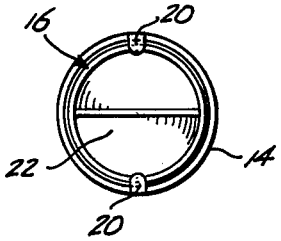
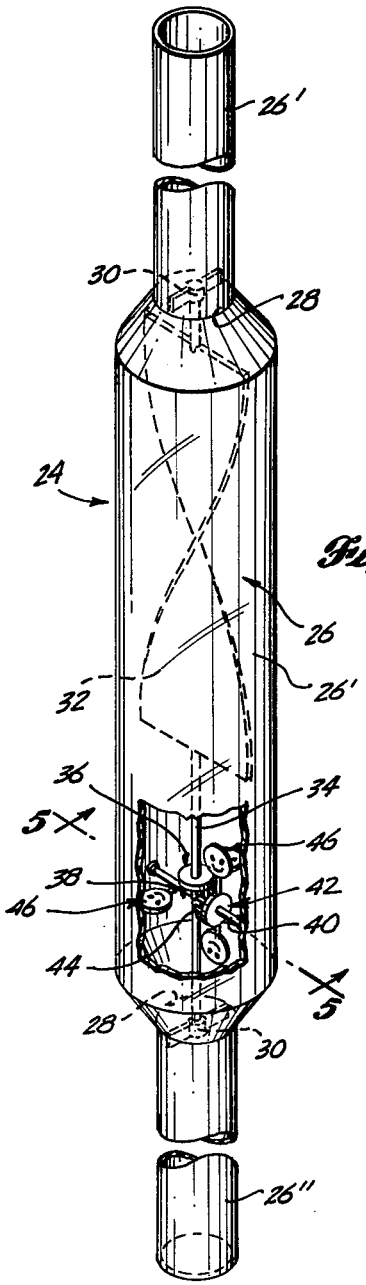
Fig. 4.
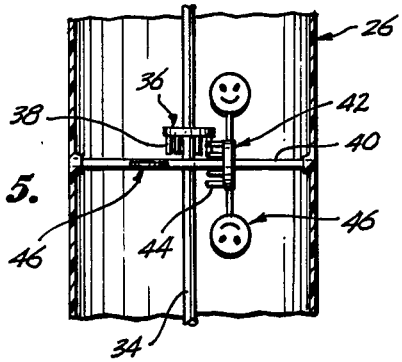
Fig. 5.

AMUSEMENT DRINKING DEVICE

RELATED APPLICATION

The present application is a Continuation-In-Part of co-pending U.S. Pat. application Ser. No. 901,342, filed May 1, 1978 and entitled AMUSEMENT DRINKING DEVICE now abondoned.

THE INVENTION IN GENERAL

This invention relates to a drinking device which is adapted to be amusing to the user while it is in use. The device is particularly useful for entertaining children.

The drinking device comprises an elongated hand supportable siphoning element having tubular end portions thereon which are adapted so that they can be inserted in the mouth of the user and in a body of liquid, respectively, for purposes of enabling the user to suck the liquid up through the element in the manner of a straw. The element also has an intermediate portion which is interposed between the end portions and defines a passage for the flow of the liquid therebetween. There is a rotor rotatably mounted on the intermediate portion for the amusement of the user, and drive means are disposed in the passage in connection with the rotor whereby the rotor is caused to undergo rotation in response to flow of the liquid through the passage.

The rotor may be disposed on the outside of the element to rotate in the ambient air; or the intermediate portion of the element may have a transparent body, and the rotor may be disposed in the transparent body of the same to rotate therein. Also, the passage may be defined by the transparent body and the rotor may be disposed in the passage to rotate therein. If desired, a plurality of rotors may be employed. Also, two or more differing rotors may be employed on the same device.

The drive means may include a reaction wheel which is mounted in the passage and adapted to be rotated by reaction of the liquid with the same as the liquid flows under suction through the passage. Moreover, in the case where the intermediate portion of the element has a transparent body defining the passage and the rotor is disposed in the passage, the rotor itself may take the form of a reaction wheel so that it is rotated by reaction of the liquid with the same as the liquid flows under suction through the passage.

The reaction wheel may take the form of a turbine wheel, a paddle wheel, a propeller, or some other type of liquid reactive wheel. Also, a plurality of wheels may be employed.

The reaction wheel may be mounted to rotate about an axis generally lengthwise of the passage, or about an axis crosswise of the passage. Also, the passage may extend generally lengthwise of the axis or axes of the end portions of the device; or the passage may extend crosswise the axis or axes of the end portions.

In certain of the presently preferred embodiments of the invention, the intermediate portion of the siphoning element takes the form of a tube section having the reaction wheel journalled therein. In some cases the wheel is journalled between bearings in the opposing ends of the tube section, so as to be rotatable about an axis parallel to the tubular axis of the section. In other cases the wheel is journalled between bearings in opposing sides of the wall of the tube section, so as to be rotatable about an axis crosswise the tubular axis thereof. Also, in the case of the former, the wheel may be journalled to rotate about the tubular axis of the section, or it may be journalled to rotate about an axis laterally offset therefrom. Where it is journalled to rotate about the tubular axis, or about an axis crosswise thereof, the end portions of the siphoning element are normally interconnected with the ends of the tube section to channel the liquid along a parallel to the tubular axis of the same. Where the wheel is journalled to rotate about a laterally offset axis, the end portions of the siphoning element are normally interconnected with opposing sides of the wall of the tube section to channel the liquid along a line crosswise the tubular axis thereof.

In certain of the presently preferred embodiments of the invention, moreover, there is an aperture in the relatively upper side of the intermediate portion through which the passage opens to the outside of the element, and an elongated shaft connected with the drive means, which is rotatably journalled in the aperture so as to project outside of the element. The rotor is disposed on the projecting portion of the shaft, and the tubular end portions of the element extend in a generally vertical plane and are relatively downwardly inclined to one another to coincide with an arch having its apex at a point which is adapted so that when the user terminates his suction, liquid in the passage cannot excape to the outside through the aperture. For example, in certain of these latter embodiments, the intermediate portion of the element defines a cylindrical chamber, the cylindrical axis of which is spaced apart from the aforesaid axial plane of the end portions, in a generally upright disposition. The aperture is disposed in the relatively upper end of the chamber, the end portions are disposed at an oblique angle to one another and communicate with the chamber at points below the upper end thereof, and the drive means are mounted in the chamber to rotate about the cylindrical axis thereof.

Also, in certain of the presently preferred embodiments of the invention, the intermediate portion of the element comprises a pair of casing members which define the passage therein and are detachably interengaged with one another across the passage so that they can be separated from one another for purposes of cleaning the the passage. In addition, the drive means are rotatably suspended from one of the casing members, and detachably rotatably journalled in the other casing member, so that when the members are separated from one another, the drive means accompany the one casing member as it is detached from the other member. For example, in one embodiment, the passage includes a cylindrical chamber, and the casing members are disposed at opposite ends of the chamber and snap fit to one another. The one casing member has an aperture therein at the adjacent end of the chamber, and there is a rotor-equipped shaft journalled in the aperture which has a reaction wheel suspended therefrom in the chamber, that detachably engages with the end of the chamber adjacent the other casing member, to undergo rotation in response to flow of the liquid through the chamber, or alternatively, accompany the shaft and the one casing member when they are separated from the other member.

In certain embodiments of the invention, moreover, the rotor comprises a disc-like member, the opposing sides of which have sets of markings thereon, the individual sets of which constitute less than a full representation of a fanciful character, but complement one another so that when the member is rotated, the sets provide a full representation of the character to someone viewing the same from a relatively fixed point thereopposite. In other embodiments, the rotor comprises a polygonal member, the sides of which are arrayed about its axis of rotation and have different markings thereon constituting a series of interrelated fanciful characters. In addition, the element has means thereon defining a slot which is operatively disposed opposite the polygonal member to expose only the markings on one side thereof alone to view at any one time when the member is rotated and viewed through the slot.

BRIEF DESCRIPTION OF THE DRAWINGS

These features will be better understood by reference to the accompanying drawings which illustrate several embodiments of the inventive device.

In the drawings,

FIG. 1 is a perspective view of one embodiment;

FIG. 2 is a perspective view of another embodiment;

FIG. 3 is an end view of the second embodiment;

FIG. 4 is a part perspective view of a third embodiment;

FIG. 5 is a part cutaway side elevational view of the third embodiment;

DESCRIPTION OF THE PREFERRED EMBODIMENTS

Figure 6:
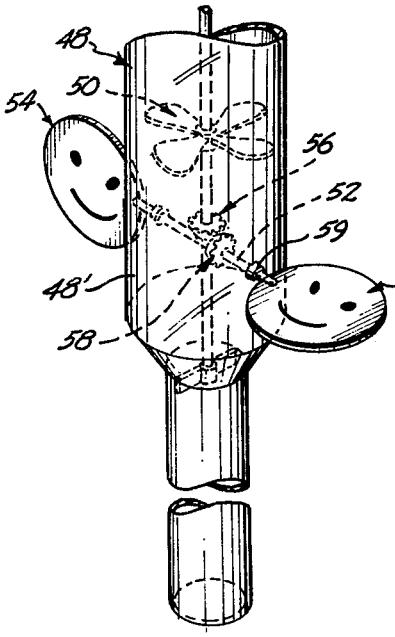
FIG. 6 is a part perspective view of a fourth embodiment.

Referring to the drawings, it will be seen that the device in FIG. 1 comprises an elongated tubular siphoning element 2, the case 4 of which is transparent and has a pair of spider mounted journal bearings 6 in the opposing ends thereof. A turbine wheel 8 is rotatably engaged in the case between the bearings. The wheel 8 comprises a helically wound ribbon or vane 10 having trunnions 12 on the ends thereof, which are rotatably engaged in the bearings so that when the user takes the upper end portion 2' of the element in his mouth and inserts the lower end portion 2'' in a liquid, the wheel 8 will undergo rotation in the bearings 6 as the user sucks the liquid up through the length of the element in the manner of a straw.

The second embodiment in FIGS. 2 and 3 employs a similar case. However, the case 14 is equipped with a turbine wheel 16 comprising a transparent tube 18 which is concentrically rotatably engaged in the case, and retained endwise of the same by pairs of bentover tabs 20 at the respective ends thereof. The tube 18 has a helically wound ribbon or vane 22 therein, similar to that in the device of FIG. 1, but the vane 22 is fixed in the tube 18 so that both undergo rotation when liquid is drawn upwardly through the device.

In FIGS. 4 and 5, the device comprises an elongated tubular siphoning element 24, the case of which, 26, is transparent and has a central portion 26' which is relatively enlarged with respect to the upper and lower end portions 26'' and 26''' thereof. The inner mouths 28 of the end portions are equipped with spider mounted journal bearings 30 and a turbine wheel 32 is axle-mounted in the central portion 26' of the case between the bearings 30. The wheel 32 is fixed on its axle 34 more adjacent the upper bearing than the lower, however, and there is a pin gear 36 on the lower portion of the axle, the pins 38 of which have a downward orientation. Also, there is a second axle 40 journalled in opposing sides of the wall of the case, crosswise of the wheel axle 34 but slightly below and to one side thereof, and this additional axle 40 is equipped with a pin gear 42 having inwardly oriented pins 44. The pins of the gears intermesh with one another so that the rotation of the axle 34 causes the axle 40 to rotate in turn; and a two-part mobile 46 is fixed on the axle 40 to rotate with it and amuse the user as he intakes liquid through the element.

In FIG. 6, the tubular case 48 of the siphoning element is similar to that in FIGS. 4 and 5, but the central portion of the same, 48', is equipped with an axle mounted propeller 50, rather than the turbine wheel 32 of FIGS. 4 and 5. Also, the additional axle 52 in FIG. 6 is equipped with a two-part mobile 54 that is disposed outside of the case, rather than inside, as in FIGS. 4 and 5. Again, however, the mobile is driven through a pair of pin gears 56 and 58, in this instance when the propeller 50 rotates in response to the flow of liquid through the element. Also, the wall bearings 59 for the additional axle in both embodiments may be sealed.

Figure 7:
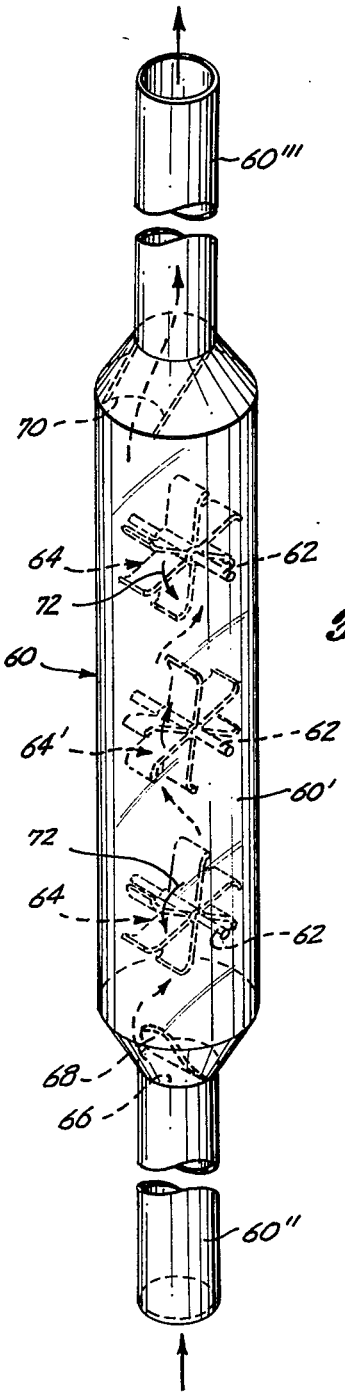
FIG. 7 is a part perspective view of a fifth embodiment.

In FIG. 7, the case 60 of the element is similar, but the central portion 60' is equipped with three crosswise axles 62, which are equipped in turn with paddle wheels 64. The intermediate paddle wheel 64' is reversed in orientation to those at the top and the bottom; and the inner mouth 66 of the bottom end portion 60'' of the case is equipped with a one-way flap valve 68 that opens upwardly to expose only the nearer side of the mouth 66. Also, the upper end portion 60''' of the case communicates with the central portion 60' through a port 70 offset to the same side of the element, so that the liquid is caused to weave reentrantly through the series of wheels 64 in the manner indicated by the arrows 72.

Figure 8:
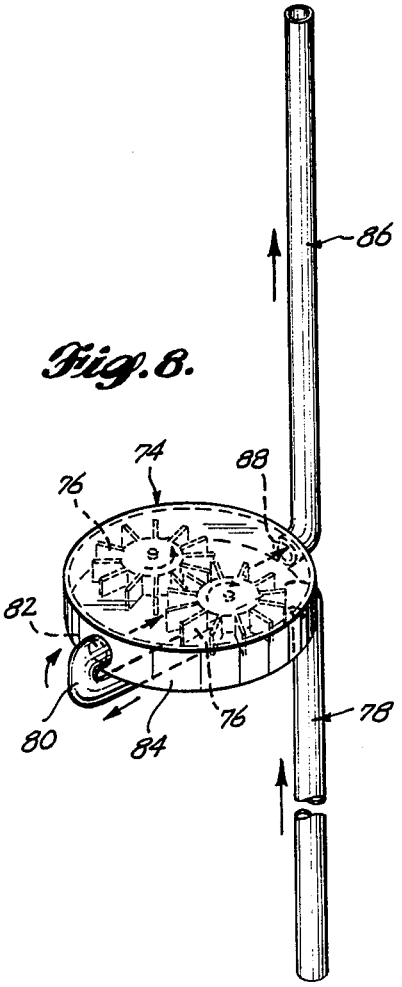
FIG. 8 is another such view of a sixth embodiment.

In FIG. 8, the central tube section 74 of the siphoning element is shallow, transparent, and disc-like in construction. It is also equipped with a pair of shallow paddle wheels 76 which intermesh with one another on mutually eccentric axes. Additionally, the lower end portion 78 of the element is right angular and affixed to the bottom of the tube section so that its upper end 80 communicates with the interior of the tube section through a port 82 in the peripheral wall or rim 84 of the section. The upper end portion 86 of the element communicates with the interior of the section in turn through another port 88 which is diametrically opposed to the port 82 in the wall or rim of the section, so that the liquid is channelled between the wheels 76 diametrically of the section, thus causing them to rotate in unison with one another as it flows through the section.

Referring now to FIGS. 9–14, it will be seen that the central portion 90 of the case of the element 92 takes the form of an upright cylindrical vessel 94 which is constructed of two rounded casing members 96 and 98 that snap fit to one another. The lower member 96 is thimble-like in construction, and has an inner peripheral rabbet 100 about the rim thereof. The upper member 98 is cap-like in construction, and is rabbeted about the rim 102 thereof to render it complementary to the rabbet 100 of the lower member for purposes of the snap fit. Inside the vessel, the two parts define a cylindrical chamber 104; and at oppositely disposed points on the perimeter of the thimble 96, there is a pair of bushings 106 which open into the chamber 104 along an axis crosswise of and spaced apart from the cylindrical axis of the chamber. The bushings 106 have tapered cross-sections in their outer ends, and the end portions 108 and 110 of the case of the element are tightly bayonneted into the ends to interconnect them with the intermediate portion.

At the lower end of the thimble 96, there is a rounded thrust bearing 112 upstanding on the bottom of the chamber, coincident with the axis thereof. The bearing has a small socket 114 therein; and at the opposite end of the chamber, the cap 98 has an axial opening 116 in the top thereof, so that a paddle wheel 118 can be rotatably supported in the chamber using the journals formed by the bearing 112 and the opening 116.

The paddle wheel has a plurality of paddles 120 which are symmetrically interconnected by a spine-like column of material 122 at the center thereof. The paddles are slightly indented at the lower end edges thereof adjacent the column 122, so that the bottom of the wheel is adapted to rotatably engage on the bearing 112, while the exposed lower tip 124 of the column forms a pintle in the socket thereof. Meanwhile, the wheel is rotatably supported at its upper end by a shaft 126 which is rotatably journalled in the opening 116 of the cap. The column 122 at the center of the wheel is enlarged at the top, and the enlargement 128 has a top-opening recess 130 therein. The shaft 126 is tightly bayonneted into the recess, as well as into a similarly recessed enlargement 132 on a disc-like member 134 which is disposed on the projecting portion of the shaft and serves as the fanciful rotor for the device.

When the device is in use, the wheel undergoes rotation and causes the rotor 134 to rotate. When the device is out of use, the cap 98 can be detached from the thimble 96 for purposes of cleaning the chamber 104, and when the cap is separated from the thimble, the wheel and rotor assembly will accompany it to facilitate the operation.

The end portion 108 of the case is substantially straight, whereas the end portion 110 has an elbow bend 136 therein, so that when the end portion 108 is held in the user's mouth at a comfortable orientation, perhaps tipped slightly downwardly from the horizontal, then the end portion 110 can be inserted conveniently into a container of liquid (not shown) therebelow. In this orientation, the liquid will flow freely through the case without escaping through the opening 116 at the top of the chamber; and in addition, when the user terminates his suction on the device, the liquid in the case cannot escape to the outside through the opening, since the opening is at the highest point on the device, or substantially so.

Figure 9:
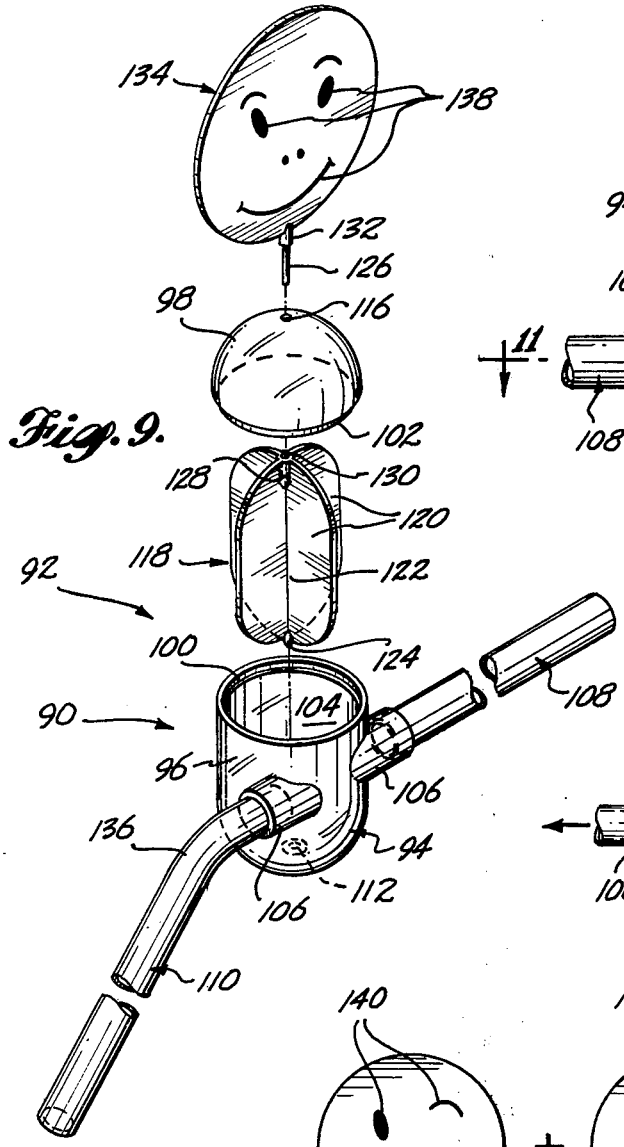
FIG. 9 is a part exploded perspective view of a seventh embodiment.
Figure 10:
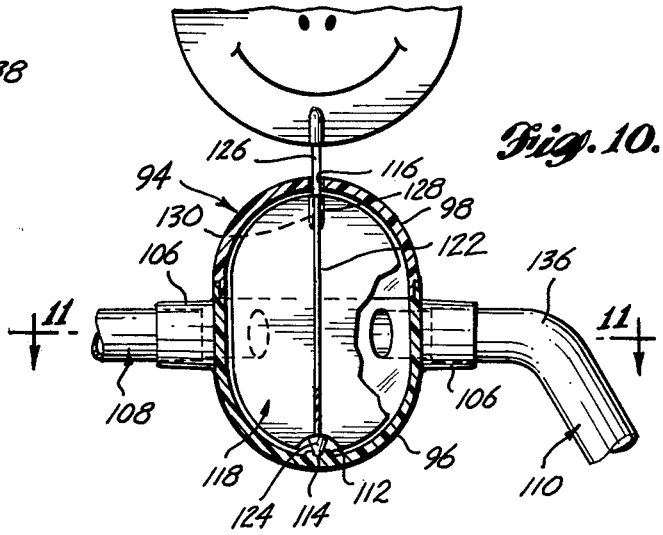
FIG. 10 is a part vertical cross-sectional view of the seventh embodiment.
Figure 11:
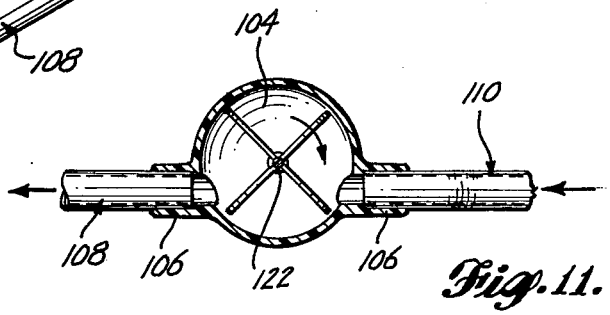
FIG. 11 is a part cross-sectional view of the seventh embodiment along the line 11—11 of FIG. 10.
Figure 12:
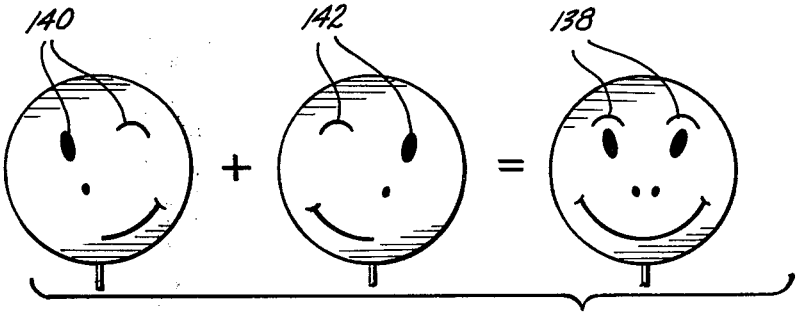
FIG. 12 is a part schematic view of a modified version of the rotor used in certain of the seven above mentioned embodiments.

In FIGS. 9–11, the rotor 134 has markings 138 on one side thereof, constituting a full representation of a fanciful character, such as a smiling face. In FIG. 12, the two sides of the rotor have sets of markings 140 and 142 thereon, that are individually less than a full representation of the fanciful character, but complementary to one another to produce the full representation 138 when the rotor is rotated.

If desired, the sets of markings in FIG. 12 may vary as to color only, or also vary in color; and the respective colors may be mixed visually by rotating the rotor. For example, blue and yellow mix visually to produce green, or red and yellow mix to produce orange. Other primary and secondary color changes are also possible.

Alternatively, the rotor 134 may be blank on both sides so that the user can add his own markings if desired.

Figure 13:
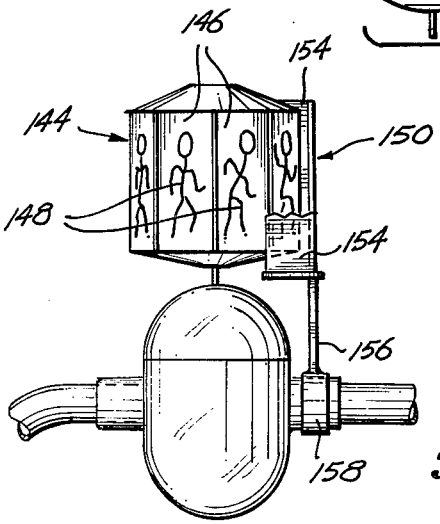
FIG. 13 is a part elevational view of an eighth embodiment.
Figure 14:
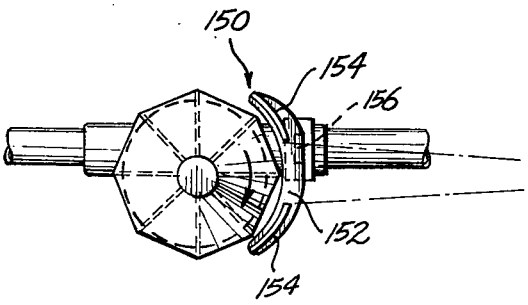
FIG. 14 is a part vertical cross-sectional view of the eighth embodiment.

In FIGS. 13 and 14, a polygonal member 144 is substituted for the disc-like rotor 134 of FIGS. 9–12. The member 144 is octagonal, and each side panel 146 of the same has a different fanciful character 148 thereon. However, the characters are interrelated in the manner of a film strip, and there is a blinder device 150 sleeved onto the bushing 106 of the end portion 108, to define a slot 152 that is adapted to expose only the character on one panel of the rotor at a time when it is rotated. In this way, the rotation of the rotor produces a film strip effect for the user as he draws the liquid through the device.

The blinder device comprises a pair of spaced blinds 154 which are supported on a standard 156 having a collar 158 at the bottom thereof.

The components of the various devices are typically made of light weight plastic.

What is claimed is:

1. A drinking device comprising a hand supportable siphoning element defining a passage for the flow of liquid between a body of liquid and the mouth of the user, said element having an aperture in the relatively upper side thereof through which the passage opens to the outside of the element, an elongated shaft rotatably journalled in the aperture so as to project outside of the element, a rotor on the projecting portion of the shaft for the amusement of the user, drive means in the passage in connection with the shaft whereby the rotor is caused to undergo rotation in response to flow of the liquid through the passage, and tubular means on opposite end portions of the element including an obliquely angled tube projecting from one of said end portions whereby such tube and a relatively straight tube on the other of said end portions can be inserted in the mouth of the user and in a body of liquid, or vice versa, for purposes of enabling the user to suck the liquid up through the element in the manner of a straw while the tubes are relatively downwardly inclined to one another to coincide with an arch having its apex at a point which is adapted so that when the user terminates his suction, liquid in the passage cannot escape to the outside through the aperture.

2. The drinking device according to claim 1 wherein the rotor comprises a disc-like member, the opposing sides of which have sets of markings thereon, the individual sets of which constitute less than a full representation of a fanciful character, but complement one another so that when the member is rotated, the sets provide a full representation of the character to someone viewing the same from a relatively fixed point thereopposite.

3. The drinking device according to claim 1 wherein the rotor comprises a polygonal member, the sides of which are arrayed about its axis of rotation and have different markings thereon constituting a series of interrelated fanciful characters there being means on the element defining a slot which is operatively disposed opposite the polygonal member so that only the markings on one side thereof alone are exposed to view at any one time when the member is rotated and viewed through the slot.

4. The drinking device according to claim 1 wherein there is a straight tube projecting from the aforesaid other end portion of the element in a common plane with the obliquely angled tube.

5. The drinking device according to claim 4 wherein the opposite end portions of the element have bushings thereon and the respective obliquely angled tube and straight tube are bayonetted into the same to interconnect them with the element.

6. The drinking device according to claim 1 wherein the element has a two-part casing, the parts of which are detachably engageable to define the passage, and wherein the shaft is rotatably journalled in one part and there is a reaction wheel suspended on the shaft in the passage in detachable engagement with the other part.

7. A drinking device comprising an elongated hand supported siphoning element having tubular end portions thereon which are adapted so that they can be inserted in the mouth of the user and in a body of liquid, respectively, for purposes of enabling the user to suck the liquid up through the element in the manner of a straw, said element having an intermediate portion thereof which is interposed between the end portions and defines a passage for the flow of the liquid therebetween, there being a rotor rotatably mounted on the intermediate portion for the amusement of the user, drive means disposed in the passage in connection with the rotor whereby the rotor is caused to undergo rotation in response to flow of the liquid through the passage, an aperture in the relatively upper side of the intermediate portion through which the passage opens to the outside of the element, and an elongated shaft connected with the drive means, which is rotatably journalled in the aperture so as to project outside of the element, the rotor being disposed on the projecting portion of the shaft, and the tubular end portions of the element extending in a generally vertical plane and being relatively downwardly inclined to one another to coincide with an arch having its apex at a point which is adapted so that when the user terminates his suction, liquid in the passage cannot escape to the outside through the aperture.

8. The drinking device according to claim 7 wherein the intermediate portion of the element defines a cylindrical chamber, the cylindrical axis of which is spaced apart from the aforesaid axial plane of the end portions, in a generally upright disposition, and wherein the aperture is disposed in the relatively upper end of the chamber, the end portions are disposed at an oblique angle to one another and communicate with the chamber at points below the upper end thereof, and the drive means are mounted in the chamber to rotate about the cylindrical axis thereof.

9. A drinking device comprising an elongated hand supportable siphoning element having tubular end portions thereon which are adapted so that they can be inserted in the mouth of the user and in a body of liquid, respectively, for purposes of enabling the user to suck the liquid up through the element in the manner of a straw, said element having an intermediate portion thereof which is interposed between the end portions and defines a passage for the flow of the liquid therebetween, there being a rotor rotatably mounted on the intermediate portion for the amusement of the user, and drive means disposed in the passage in connection with the rotor whereby the rotor is caused to undergo rotation in response to flow of the liquid through the passage, the passage including a cylindrical chamber and the intermediate portion of the element comprising a pair of casing members which define the passage at opposite ends of the chamber and are snap fitted to one another across the passage so that they can be separated from one another for purposes of cleaning the passage, one of the casing members having an aperture therein at the adjacent end of the chamber, and there being a shaft journalled in the aperture which is equipped with the rotor and has a reaction wheel suspended therefrom in the chamber, that detachably engages with the end of the chamber adjacent the other casing member to undergo rotation in response to flow of the liquid through the chamber.

* * * * *